US010386110B2

(12) United States Patent
Toschek et al.

(10) Patent No.: US 10,386,110 B2
(45) Date of Patent: Aug. 20, 2019

(54) CHEST FREEZER

(71) Applicant: REMIS GESELLSCHAFT FUER ENTWICKLUNG UND VERTRIEB VON TECHNISCHEN ELEMENTEN MBH, Cologne (DE)

(72) Inventors: Ralf Toschek, Cologne (DE); Carsten Weller, Wuppertal (DE)

(73) Assignee: REMIS GESELLSCHAFT FUER ENTWICKLUNG UND VERTRIEB VON TECHNISCHEN ELEMENTEN MBH, Cologne (DE)

( * ) Notice: Subject to any disclaimer, the term of this patent is extended or adjusted under 35 U.S.C. 154(b) by 0 days.

(21) Appl. No.: 15/116,221

(22) PCT Filed: Feb. 23, 2015

(86) PCT No.: PCT/EP2015/053751
§ 371 (c)(1),
(2) Date: Aug. 3, 2016

(87) PCT Pub. No.: WO2015/124774
PCT Pub. Date: Aug. 27, 2015

(65) Prior Publication Data

US 2016/0348956 A1 Dec. 1, 2016

(30) Foreign Application Priority Data

Feb. 21, 2014 (DE) ..... 20 2014 100 795 U

(51) Int. Cl.
*A47F 3/04* (2006.01)
*F25D 23/02* (2006.01)
(Continued)

(52) U.S. Cl.
CPC ..... *F25D 23/026* (2013.01); *A47F 3/043* (2013.01); *B65D 25/04* (2013.01); *B65D 25/28* (2013.01);
(Continued)

(58) Field of Classification Search
CPC .. F25D 23/026; F25D 23/021; F25D 2400/10; A47F 3/043; B65D 25/04; B65D 25/28; B65D 2525/283; B65D 43/20
(Continued)

(56) References Cited

U.S. PATENT DOCUMENTS 1,432,044 A * 10/1922 Vincent ..... A47B 47/025 312/107
3,366,268 A * 1/1968 Struck ..... A45D 27/22 160/202
2005/0052099 A1* 3/2005 Behr ..... A47F 3/0434 312/139.2

FOREIGN PATENT DOCUMENTS

DE 195 40 143 C1 1/1997
DE 10 2009 031 278 A1 1/2011
(Continued)

*Primary Examiner* — Fenn C Mathew
*Assistant Examiner* — Elizabeth J Volz
(74) *Attorney, Agent, or Firm* — Norman B. Thot

(57) ABSTRACT

A chest freezer includes a chest body which includes a cooling chamber which is accessible from above, a covering hood which covers a top of the chest body, and two access sides arranged opposite to each other from which an access to the cooling chamber exists when the covering hood is in an open position. The covering hood includes a triple sliding lid arrangement which includes two three-track rail profiles arranged parallel to each other and transversely to the two access sides, each of the two three-track rail profiles include a lower, a middle and an upper track, two side sliding lids which, in a closed position, are arranged at the two access sides, and a central sliding lid which, in a central position,
(Continued)

is arranged approximately centrally between the two side sliding lids. The central sliding lid is guided in the lower track of the two three-track rail profiles.

14 Claims, 5 Drawing Sheets

(51) Int. Cl.
*B65D 25/04* (2006.01)
*B65D 25/28* (2006.01)
*B65D 43/20* (2006.01)

(52) U.S. Cl.
CPC ..... *B65D 43/20* (2013.01); *B65D 2525/283* (2013.01)

(58) Field of Classification Search
USPC ..... 312/116, 117, 138.1, 139.2; 220/592.02, 220/345.5; 49/413, 453
See application file for complete search history.

(56) References Cited

FOREIGN PATENT DOCUMENTS

| | | | | | |
|---|---|---|---|---|---|
| DE | 102009031278 | * | 1/2011 | ..... | A47F 3/04 |
| EP | 0 769 262 | A2 | 4/1997 | | |
| EP | 1 332 698 | A1 | 8/2003 | | |
| EP | 2233868 | * | 9/2010 | ..... | F25D 23/026 |
| EP | 2 347 680 | A1 | 7/2011 | | |
| WO | WO 2012/066429 | A1 | 5/2012 | | |

* cited by examiner

CHEST FREEZER

CROSS REFERENCE TO PRIOR APPLICATIONS

This application is a U.S. National Phase application under 35 U.S.C. § 371 of International Application No. PCT/EP2015/053751, filed on Feb. 23, 2015 and which claims benefit to German Patent Application No. 20 2014 100 795.4, filed on Feb. 21, 2014. The International Application was published in German on Aug. 27, 2015 as WO 2015/124774 A1 under PCT Article 21(2).

FIELD

The present invention relates to a chest freezer having a chest body including at least one cooling chamber that is accessible from above and a covering hood which covers the top of the chest body. The present invention further relates to a covering hood for equipping a chest freezer body, for example, as original equipment or by retrofitting.

BACKGROUND

A chest freezer may be a chest freezer for cooling food at a cooling temperature higher than 0° C. or a so-called deep freezer for cooling food at a temperature below 0° C. The chest freezer is in particular a commercial chest freezer which may often have a length of several meters up to more than 10 m. The present invention primarily relates to a so-called "island freezer" that is accessible from two opposite access sides. Such chest freezers often have a transverse dimension of 1 to 3 meters from one access side to the other.

To reduce heat introduction into the cooling chamber, the chest body is covered with a covering hood having transparent sliding lids. Such a chest freezer including a covering hood is described in EP 0 769 262 A1. The covering hood has transparent sliding lids slidably supported in two tracks offset in height, wherein the sliding lids are each slidable in parallel with the access sides. Although it is possible to slide two or even more sliding lids of one longitudinal side over each other, the cooling chamber below the sliding lids which are slid over each other is then not accessible from above.

EP 1 332 698 A1 describes a chest freezer with a covering hood which has a plurality of multi-track rail profiles spanning the cooling chamber in the transversal direction, i.e., transversely to the two access sides. Two adjacent rail profiles are part of a respective arrangement of three sliding lids, wherein the central pane is fixed in a stationary manner at the rail profile, and the two sliding lids at the edges can each be slid to the center below the central pane arranged at the highest level. Access to the cooling chamber in the chest freezer is thereby always possible from both access sides. It is not possible to access the chest body from above in the middle between the two access sides since the central pane is stationary.

SUMMARY

An aspect of the present invention is to provide a chest freezer having a covering hood and/or a covering hood which provides improved access to the chest body from above.

In an embodiment, the present invention provides a chest freezer which includes a chest body. The chest body includes at least one cooling chamber which is configured to be accessible from above, a covering hood which is configured to cover a top of the chest body, and two access sides arranged opposite to each other from which an access to the cooling chamber exists when the covering hood is in an open position. The covering hood comprises a triple sliding lid arrangement which comprises two three-track rail profiles arranged parallel to each other and transversely to the two access sides, each of the two three-track rail profiles comprising a lower track, a middle track and an upper track, two transparent side sliding lids which, in a closed position, are arranged at the two access sides, and a transparent central sliding lid which, in a central position, is arranged approximately centrally between the two transparent side sliding lids. The transparent central sliding lid is guided in the lower track of the two three-track rail profiles.

BRIEF DESCRIPTION OF THE DRAWINGS

The present invention is described in greater detail below on the basis of embodiments and of the drawings in which.

DETAILED DESCRIPTION

Figure 1:
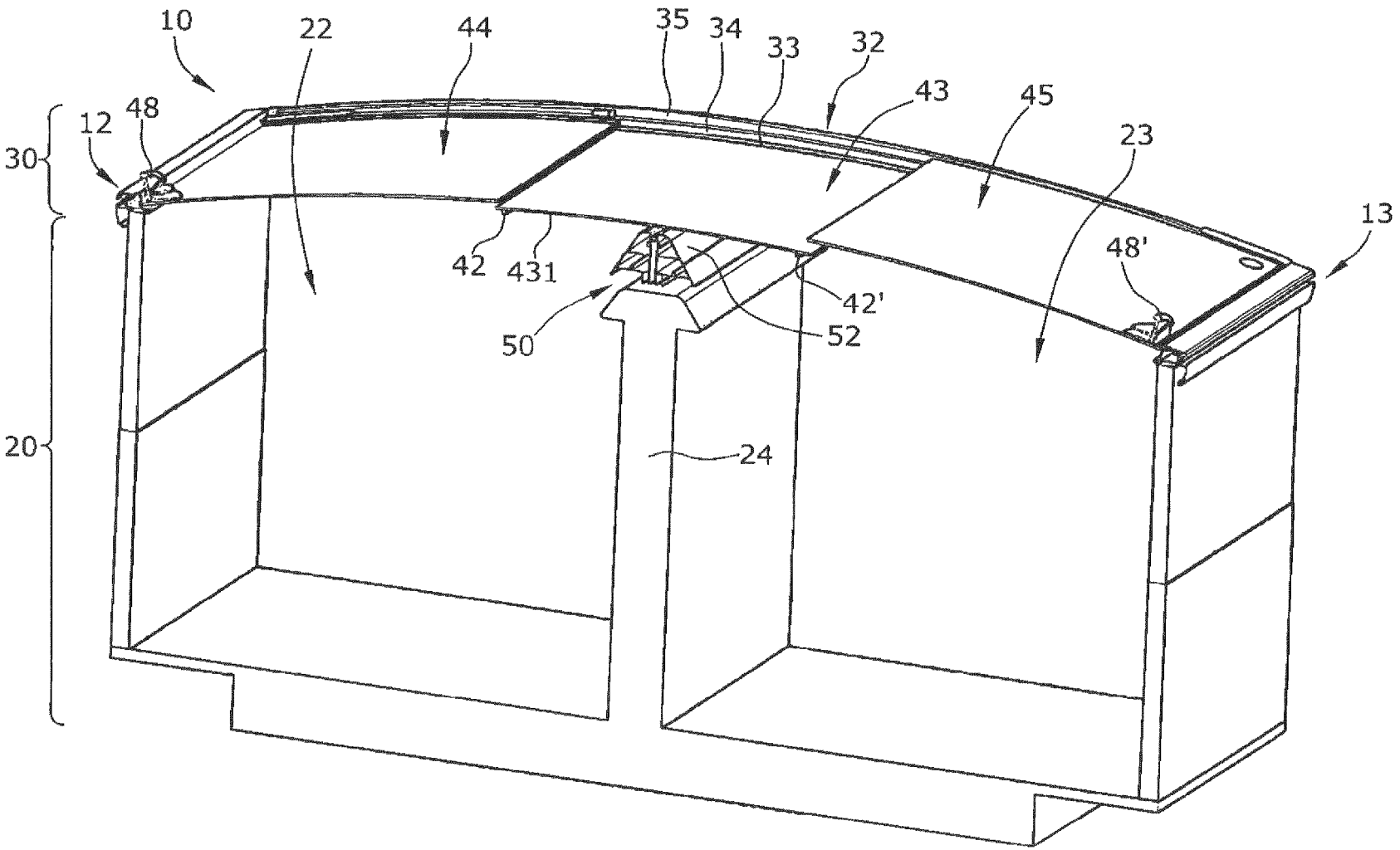
FIG. 1 shows a perspective cross section of a chest freezer with three sliding lids in a closed position.

The chest freezer of the present invention comprises a chest body with at least one cooling chamber accessible from above and a covering hood covering the top of the chest body. The covering hood or the chest body has two opposite access sides from which the cooling chamber may be accessed from above when the covering hood is open.

The covering hood has at least one arrangement of three sliding lids which is formed by two mutually parallel three-track rail profiles and three transparent sliding lids slidably arranged in the three tracks in a manner vertically offset with respect to each other. Not only the two sliding lids on the sides are slidable transversely to the access sides, but the central sliding lid is also designed to be slidable transversely to the access sides. The central sliding lid is also not arranged above the two rail profile tracks of the two side sliding lids, but is respectively guided in the lower track of the rail profile. The central sliding lid and at least one side sliding lid may be slid one above the other, i.e., be superimposed one upon the other, not only in the central closing position of the central sliding lid, but also beyond the closing position of the central sliding lid. Since the central sliding lid is also slidable, the central part of the chest body is also accessible from above if the central sliding lid is shifted from its central closing position.

The central sliding lid is not guided in the upper or the middle track, but in the lower rail profile track. Due to this position of the central sliding lid, the two abutment edges, i.e., the longitudinal edges of the central sliding lid, which are parallel with the access sides, are covered by the two side sliding lids in the closing position of all sliding lids. If, for example, a shopping bag is placed on one of the side sliding lids and this side sliding lid is slid towards the center into its open position, the shopping bag will not collide with the central sliding lid since the side sliding lid is arranged above the central sliding lid. By arranging the central sliding lid in the lower rail profile track, it is generally provided that the central sliding lid is always in its central closing position and is not inadvertently slid out of its closed central closing position due to negligence or faulty operation. Operating safety is thus increased.

The covering hood may have a plurality of arrangements of three sliding lids arranged side by side.

In an embodiment of the present invention, the central sliding lid can, for example, have a raised handle on its lower side. A raised handle should thereby be understood as a handle that protrudes downward from the lower surface of the transparent sliding lid pane. The central sliding lid may easily be gripped and slid using the handle on the lower side. Since the handle is arranged on the lower side, the vertical offset or distance of the central sliding lid to the two sliding lids above, or the vertical distance of the tracks, may be kept small. The gap dimensions between the three sliding lids of an arrangement of tree sliding lids can thereby be kept very small.

In an embodiment of the present invention, the two side sliding lids of an arrangement of three sliding lids can, for example, each have a raised grip on the upper side of the sliding lid. Since the central sliding lid is arranged in the lowermost plane of the arrangement of three sliding lids, both side sliding lids can be shifted (despite the handle) beyond the respective longitudinal side of the central sliding lid directed toward the sliding lids. A side sliding lid can, for example, be slid into its central opening position above the central sliding lid, whereupon the central sliding lid may be gripped and be slid into its opening position that corresponds to the closing position of the side sliding lid previously slid open. The side sliding lid previously opened may thereafter again be slid into its closed position. The central part of the chest body can thereby be opened in a simple manner from above, whereby the central part becomes accessible from above.

In an embodiment of the present invention, the three rail profile tracks can, for example, be arranged in a stair-like manner relative to each other, as seen in cross section. As a result, the lower central sliding lid has a shorter dimension in the longitudinal direction, i.e., parallel to the access sides, than the side sliding lid supported in the adjacent track above. The sliding lid guided in the upper track has a larger dimension in the longitudinal direction than the side sliding lid guided in the central track. This significantly facilitates assembly and disassembly of the three sliding lids since they can be placed into the two rail profiles one after the other from the bottom to the top.

In an embodiment of the present invention, the lower rail profile track can, for example, extend over the entire transverse dimension of the rail profile track, wherein the lower rail profile track has no fixed stoppers assigned thereto. The central sliding lid can thus be shifted over the entire transverse dimension, while the side sliding lids are in their closed state.

In an embodiment of the present invention, the chest body can, for example, have two cooling chambers separated by a partition wall parallel to the access sides, the partition wall being arranged approximately in the middle of the chest body. The covering hood has a supporting base that is supported on the partition wall. The supporting base can, for example, support one or a plurality of rail profiles in the center of the rail profile. Chest bodies with two longitudinally extending cooling chambers have a large transverse dimension so that the three sliding lids also each have a large transverse dimension. The overall weight of the three sliding lids therefore is correspondingly great, the lids generally consisting essentially of one or even two glass panes.

To avoid a deformation of the rail profiles and to allow for the use of rail profiles of plastic material, a rail profile, in particular a double rail profile of a covering hood having at least two arrangements of three sliding lids, can, for example, be supported vertically in the middle of the chest by the supporting base on the chest body partition wall. The rail profiles and the sliding lids can, for example, be designed to be convexly curved upward.

With a chest body having two cooling chambers and a partition wall parallel to the access sides, a product information carrier is fastened on and/or at the partition wall, the carrier extending parallel to the two access sides and allowing for the attachment of product information thereon. The product information may be designed as printed plates, but may also be designed as an electronic display. The product information can thereby be arranged in the cooled space below the sliding lids, i.e., it can be placed in very close proximity to the corresponding goods. The product information is thereby put into a better and closer spatial relationship with the goods to which they relate. It is nevertheless provided by the slidable central sliding lid that the product information carrier and/or the product information is relatively simple to access so as to be able to replace and/or change.

In an embodiment of the present invention, the supporting base can, for example, comprise the product information carrier or both being combined into one structural unit. Two useful functions are thereby realized with one component, i.e., stability and improved product information.

In an embodiment of the present invention, a covering hood as described above is provided for equipping a chest body. This provides a modular covering hood that is suited for original equipment and/or for retrofitting a corresponding chest freezer body.

A detailed description of an embodiment of the present invention is set forth below under reference to the drawings.

FIG. 1 shows a commercial chest freezer 10 which in the present case is a deep freezer. The chest freezer 10 is elongate in shape so that its longitudinal dimension is a multiple of its transverse dimension. The chest freezer 10 is a so-called "island chest freezer" so that the chest body interior is accessible from two opposite access sides 12, 13.

The chest freezer 10 comprises a chest body 20 with lateral walls and a modular covering hood 30 set on the chest body 20 from above and fixed thereon. The covering hood 30 may be mounted on the chest body 20 as original equipment, but it may alternatively be retrofitted thereto.

The chest body 20 has two separate and longitudinally extending cooling chambers 22, 23 that each have their own cooling. The two cooling chambers 22, 23 are separated by a vertical partition wall 24 parallel to the two access sides 12, 13, the vertical partition wall 24 having approximately the same height as the lateral walls of the chest body 20.

The covering hood 30 has a plurality of arrangements 11 of three sliding lids, which each span the two cooling chambers 22, 23 in the transverse direction. The arrangement 11 of three sliding lids is formed substantially by a pair of rail profiles 32, 32' having three tracks 33, 34, 35 and three sliding lids 43, 44, 45 which are slidably supported and guided in the three tracks 33, 34, 35 of the rail profiles 32, 32'. The two rail profiles 32, 32' of a pair are formed mirror-symmetrically, are parallel to each other, and face each other. Each rail profile 32, 32' has a stair-like structure, wherein the three steps of the stair form a lower track 33, a middle track 34, and an upper track 35, as is shown in FIG.

3. A double rail profile 31 is provided where two arrangements 11 of three sliding lids adjoin each other, the double rail profile 31 having one rail profile 32, 32' on either side.

A respective side sliding lid 44, 45, slidable in the transverse direction, is supported in the middle track 34 and the upper track 35 of a rail profile 32, 32', the sideway closing position of the lid being shown in FIG. 1. A transversely slidable central sliding lid 43 is supported in the lower track 33, which is also shown in its central closing position in FIG. 1. All tracks 33, 34, 35 extend substantially along the entire transverse dimension of the covering hood 30 or the chest body 20. The sliding lids 43, 44, 45 and the rail profiles 32, 33' or the tracks 33, 34, 35 are convexly curved outward, wherein the curvature may be exactly circular or non-circular. The tracks 33, 34, 35 are arranged at a continuous vertical distance from each other over the entire transverse dimension.

Each sliding lid 43, 44, 45 is formed essentially by a correspondingly curved transparent glass pane. The two side sliding lids 44, 45 each have a raised handle 48, 48' near the two access sides 12, 13 on the upper side of the respective sliding lid or the respective glass pane, whereby the side sliding lids 44, 45 can be easily gripped and shifted manually in the transverse direction. The central sliding lid 43 has no raised structure on the upper side. On the lower side 431 of the central sliding lid 43, raised central lid handles 42, 42' are provided at the two transverse ends thereof, so that the central sliding lid 43 can be easily grasped from its bottom side and be shifted, and can in particular be pulled towards the side as shown in FIG. 4.

Figure 2:
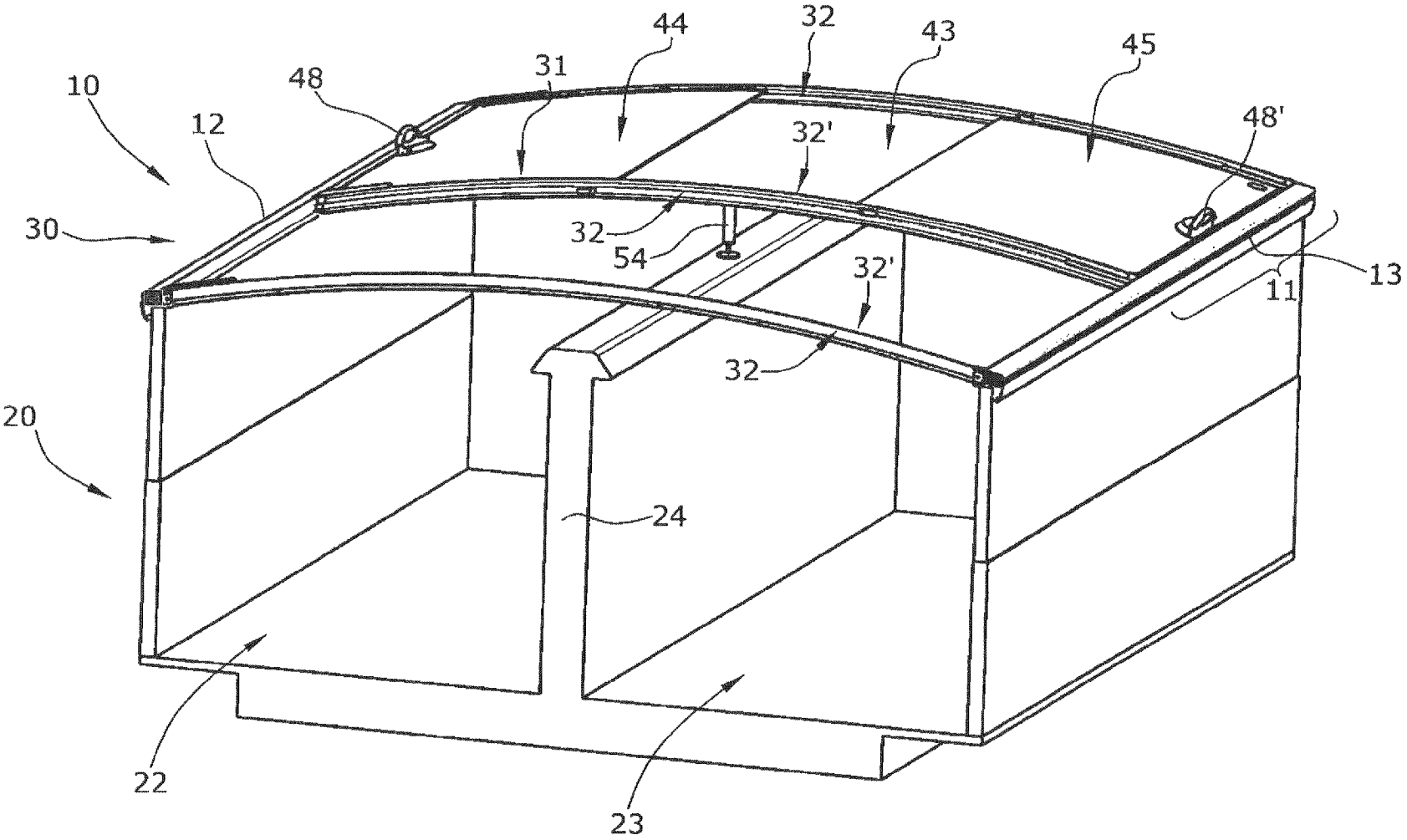
FIG. 2 shows a second cross section of the chest freezer in FIG. 1.
Figure 3:
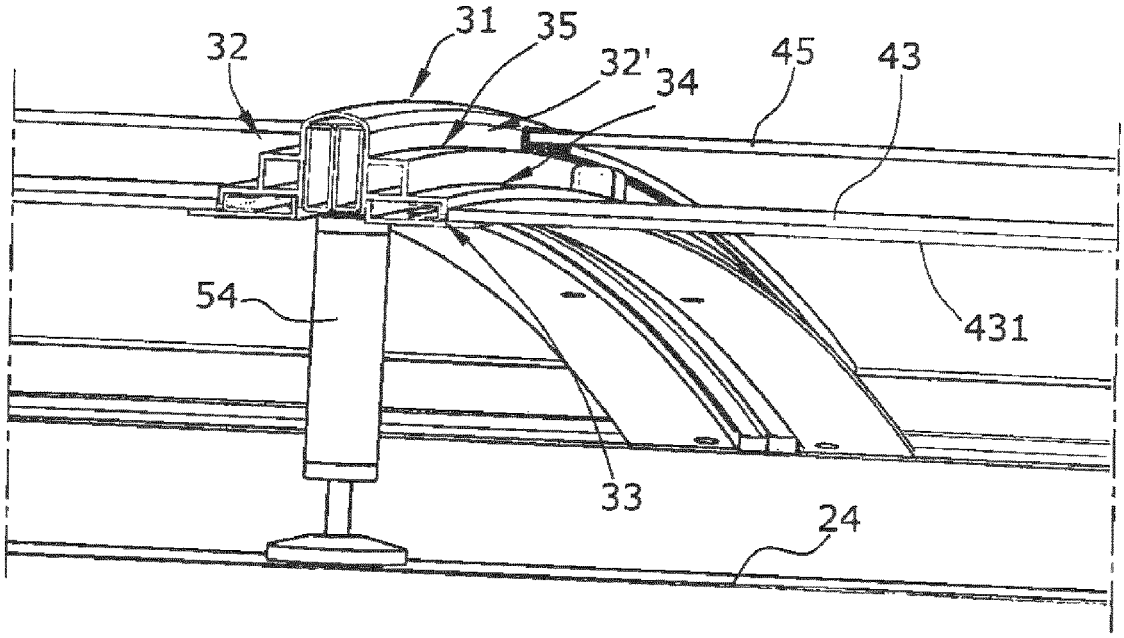
FIG. 3 shows a detail of a double rail profile in longitudinal section.

As shown in FIGS. 2 and 3, the covering hood 30 has a supporting base 54 by which a rail profile 32, 32' and/or a double rail profile 31 is supported in the upper side of the vertical partition wall 24 of the cooling chamber 22.

Figure 4:
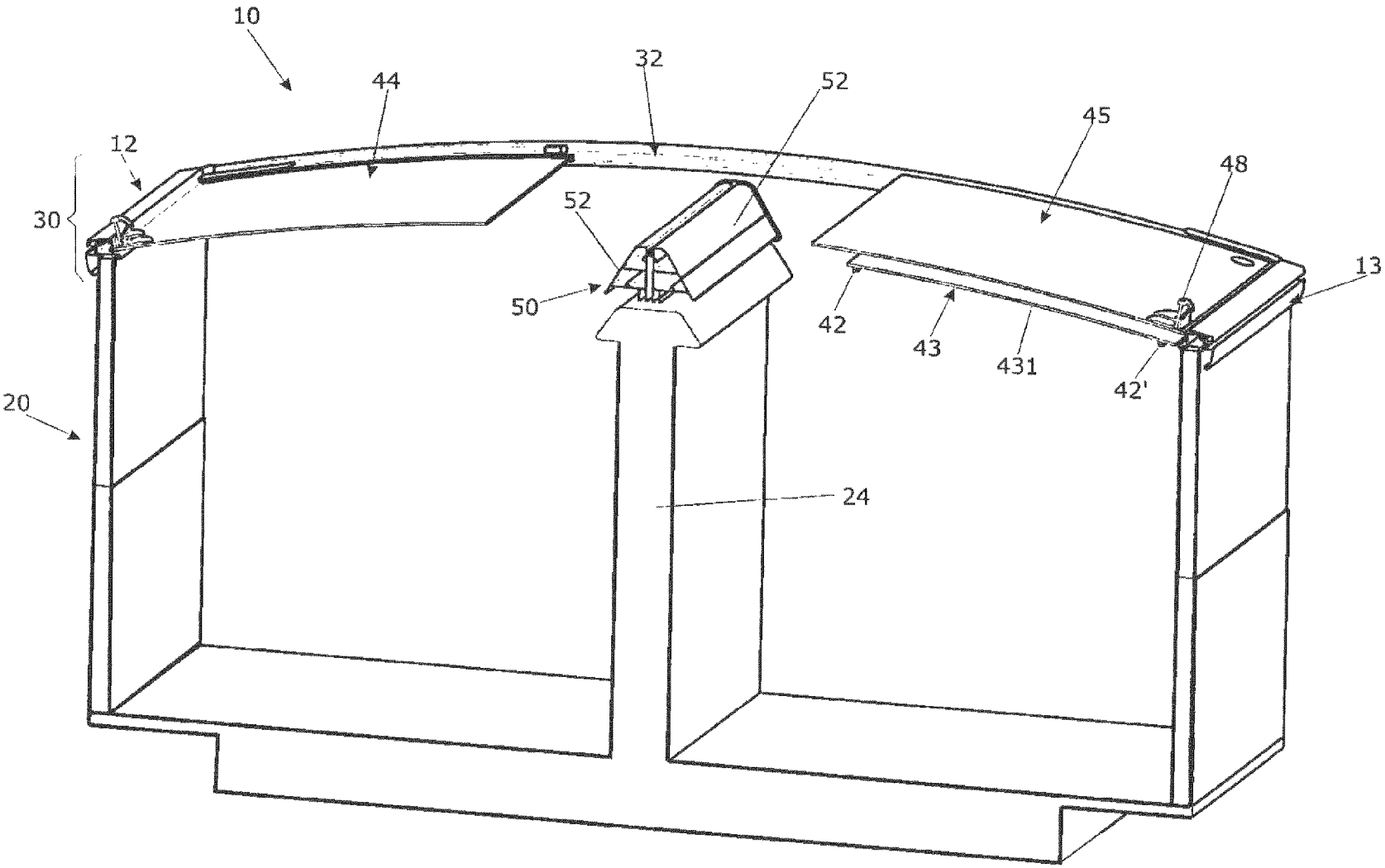
FIG. 4 shows the chest freezer in FIG. 1 with the central sliding lid open.
Figure 5:
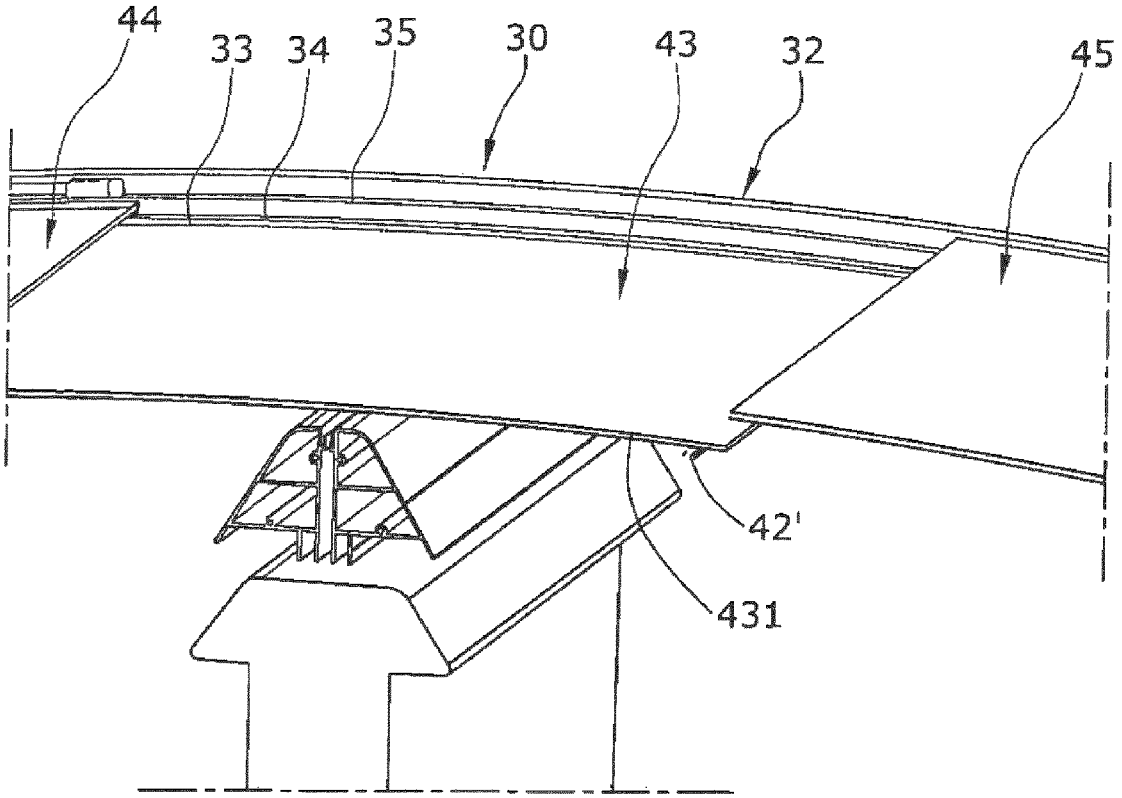
FIG. 5 shows an enlarged illustration of the central sliding lid of the chest freezer in FIG. 1.

As shown in FIGS. 1 and 4, a product information carrier 50 is fastened on the vertical partition wall 24 between the supporting bases 54, respectively, the product information carrier 50 extending in parallel with the two access sides 12, 13 and having product information 52 attached thereon.

The present invention is not limited to embodiments described herein; reference should be had to the appended claims.

What is claimed is:

1. A chest freezer comprising:

a chest body comprising:

at least one cooling chamber which is configured to be accessible from above;

a covering hood which is configured to cover a top of the chest body; and two access sides arranged opposite to each other from which an access to the cooling chamber exists when the covering hood is in an open position, wherein, the covering hood comprises a triple sliding lid arrangement which comprises:

two three-track rail profiles arranged parallel to each other and transversely to the two access sides, each of the two three-track rail profiles comprising a lower track, a middle track and an upper track;

two transparent side sliding lids which, in a closed position, are arranged at the two access sides; and a transparent central sliding lid which, in a central position, is arranged approximately centrally between the two transparent side sliding lids, the transparent central sliding lid being guided in the lower track of the two three-track rail profiles, and the lower track, the middle track and the upper track are each arranged in a stair-like manner with respect to each other, when seen in a cross section.

2. The chest freezer as recited in claim 1, wherein the transparent central sliding lid comprise a raised handle on a lower side.

3. The chest freezer as recited in claim 1, wherein the two transparent side sliding lids each comprise a raised handle on an upper side.

4. The chest freezer as recited in claim 1, wherein the lower track is configured to extend over an entire transverse extension of the two three-track rail profiles and comprising no fixed stoppers so that, when the two transparent side sliding lids are in an open position, the transparent central sliding lid can be slid over the entire transverse extension of the two three-track rail profile.

5. The chest freezer as recited in claim 1, wherein, the chest body further comprises:

a partition wall extending parallel to the two access sides; and two cooling chambers separated by the partition wall, and the covering hood further comprises:

a supporting base configured to be supported on the partition wall and to support at least one of the two three-track rail profiles at a center thereof.

6. The chest freezer as recited in claim 1, wherein, the chest body further comprises:

a partition wall extending parallel to the two access sides;

two cooling chambers separated by the partition wall, and a product information carrier configured to be fastened on the partition wall, the product information carrier extending parallel to the two access sides and being configured to have product information be attached thereon.

7. A covering hood for equipping a chest body, the covering hood being configured to cover a top of the chest body, the covering hood comprising a triple sliding lid arrangement which comprises:

two three-track rail profiles arranged parallel to each other, each of the two three-track rail profiles comprising a lower track, a middle track and an upper track, the two three-track rail profiles being arranged transversely to the two access sides;

two transparent side sliding lids which, in a closed position, are arranged at the two access sides; and a transparent central sliding lid which, in a central position, is arranged approximately centrally between the two transparent side sliding lids, the transparent central sliding lid being guided in the lower track of the two three-track rail profiles, wherein, the lower track, the middle track and the upper track are each arranged in a stair-like manner with respect to each other, when seen in a cross section.

8. A chest freezer comprising:

a chest body comprising:

at least one cooling chamber which is configured to be accessible from above;

a covering hood which is configured to cover a top of the chest body; and two access sides arranged opposite to each other from which an access to the cooling chamber exists when the covering hood is in an open position, wherein, the covering hood comprises a triple sliding lid arrangement which comprises:

two three-track rail profiles arranged parallel to each other and transversely to the two access sides, each of the two three-track rail profiles comprising a lower track, a middle track and an upper track;

two transparent side sliding lids which, in a closed position, are arranged at the two access sides; and a transparent central sliding lid which, in a central position, is arranged approximately centrally between the two transparent side sliding lids, the transparent central sliding lid being guided in the lower track of the two three-track rail profiles, and the lower track is configured to extend over an entire transverse extension of the two three-track rail profiles and comprising no fixed stoppers so that, when the two transparent side sliding lids are in an open position, the transparent central sliding lid can be slid over the entire transverse extension of the two three-track rail profile.

9. The chest freezer as recited in claim 8, wherein the transparent central sliding lid comprise a raised handle on a lower side.

10. The chest freezer as recited in claim 8, wherein the two transparent side sliding lids each comprise a raised handle on an upper side.

11. The chest freezer as recited in claim 8, wherein the lower track, the middle track and the upper track are each arranged in a stair-like manner with respect to each other, when seen in a cross section.

12. The chest freezer as recited in claim 8, wherein, the chest body further comprises:

a partition wall extending parallel to the two access sides; and two cooling chambers separated by the partition wall, and the covering hood further comprises:

a supporting base configured to be supported on the partition wall and to support at least one of the two three-track rail profiles at a center thereof.

13. The chest freezer as recited in claim 8, wherein, the chest body further comprises:

a partition wall extending parallel to the two access sides;

two cooling chambers separated by the partition wall, and a product information carrier configured to be fastened on the partition wall, the product information carrier extending parallel to the two access sides and being configured to have product information be attached thereon.

14. A covering hood for equipping a chest body, the covering hood being configured to cover a top of the chest body, the covering hood comprising a triple sliding lid arrangement which comprises:

two three-track rail profiles arranged parallel to each other, each of the two three-track rail profiles comprising a lower track, a middle track and an upper track, the two three-track rail profiles being arranged transversely to the two access sides;

two transparent side sliding lids which, in a closed position, are arranged at the two access sides; and a transparent central sliding lid which, in a central position, is arranged approximately centrally between the two transparent side sliding lids, the transparent central sliding lid being guided in the lower track of the two three-track rail profiles, wherein, the lower track is configured to extend over an entire transverse extension of the two three-track rail profiles and comprising no fixed stoppers so that, when the two transparent side sliding lids are in an open position, the transparent central sliding lid can be slid over the entire transverse extension of the two three-track rail profile.

* * * * *